US008282092B2

(12) United States Patent
Yasui et al.

(10) Patent No.: US 8,282,092 B2
(45) Date of Patent: Oct. 9, 2012

(54) IMAGE FORMING APPARATUS

(75) Inventors: Kazumasa Yasui, Arakawa-ku (JP); Masaya Arakawa, Hiratsuka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/243,932

(22) Filed: Sep. 23, 2011

(65) Prior Publication Data

US 2012/0014731 A1 Jan. 19, 2012

Related U.S. Application Data

(62) Division of application No. 12/484,659, filed on Jun. 15, 2009, now Pat. No. 8,047,528.

(60) Provisional application No. 61/073,007, filed on Jun. 16, 2008, provisional application No. 61/073,009, filed on Jun. 16, 2008, provisional application No. 61/073,014, filed on Jun. 16, 2008.

(51) Int. Cl.
*B65H 3/44* (2006.01)

(52) U.S. Cl. ..... 271/9.01; 271/9.13; 271/242; 271/270

(58) Field of Classification Search ..... 271/9.01, 271/9.11, 9.12, 9.13, 242, 270, 10.01, 10.09, 271/10.11, 10.12; 399/391, 394, 396, 388, 399/389

See application file for complete search history.

(56) References Cited

U.S. PATENT DOCUMENTS

| | | | | |
|---|---|---|---|---|
| 6,893,175 | B2 | 5/2005 | Sussmeier et al. | |
| 7,123,873 | B2 * | 10/2006 | deJong et al. | 399/381 |
| 7,293,769 | B2 | 11/2007 | Asari et al. | |
| 7,370,863 | B2 | 5/2008 | Yasui et al. | |
| 7,556,254 | B2 * | 7/2009 | Wada | 271/9.02 |
| 7,796,909 | B2 * | 9/2010 | Nishimura | 399/75 |
| 2004/0184058 | A1 * | 9/2004 | Miyajima | 358/1.12 |
| 2004/0247355 | A1 * | 12/2004 | Eguchi | 399/391 |
| 2007/0194521 | A1 | 8/2007 | Matsumoto et al. | |
| 2007/0235921 | A1 | 10/2007 | Schalk et al. | |
| 2008/0211177 | A1 | 9/2008 | Obuchi et al. | |
| 2008/0232880 | A1 | 9/2008 | Noguchi et al. | |
| 2008/0277865 | A1 | 11/2008 | Yasui et al. | |
| 2009/0309291 | A1 * | 12/2009 | Yasui et al. | 271/9.01 |

FOREIGN PATENT DOCUMENTS

| | | |
|---|---|---|
| JP | 2002-12333 | 1/2002 |
| JP | 2005-96910 | 4/2005 |
| JP | 2007-320760 | 12/2007 |
| JP | 2008-110835 | 5/2008 |

* cited by examiner

*Primary Examiner* — David H Bollinger
(74) *Attorney, Agent, or Firm* — Patterson & Sheridan, LLP

(57) ABSTRACT

To provide an image forming apparatus that can highly accurately position and convey, even if an inter-sheet distance of sheets to be conveyed is reduced, the sheets from registration rollers to a transfer position when a toner image on an image bearing member moving at process speed is transferred onto the sheet in the transfer position. A sheet fed from a paper feeding cassette by a pulse-motor driven paper feeding roller is conveyed to pulse-motor driven registration rollers by pulse-motor driven conveying rollers. When the sheet is conveyed to the transfer position according to restart of the registration rollers, the sheet is conveyed by the registration rollers at sheet conveying speed different from the process speed before the leading end of the sheet reaches the transfer position and is conveyed at the process speed after that.

18 Claims, 7 Drawing Sheets

IMAGE FORMING APPARATUS

CROSS-REFERENCE TO RELATED APPLICATION

This application is a divisional of U.S. patent Ser. No. 12/484,659 which is based upon and claims the benefit of priority from: U.S. provisional application 61/073,007, filed on Jun. 16, 2008; U.S. provisional application 61/073,009, filed on Jun. 16, 2008; and U.S. provisional application 61/073,014, filed on Jun. 16, 2008, the entire contents of each of which are incorporated herein by reference.

TECHNICAL FIELD

The present invention relates to an image forming apparatus including a sheet conveying device that, in order to transfer an unfixed toner image onto a sheet, feeds and conveys the sheet and conveys the sheet to a printing position (a transfer position) to be timed to coincide with the transfer of the sheet using registration rollers, and, more particularly to an image forming apparatus that can change, according to a change in a distance between sheets continuously conveyed (an inter-sheet distance), conveying speed of a sheet delivered from the registration rollers.

BACKGROUND

Conventionally, an image forming apparatus such as a color printer includes a sheet conveying device that conveys a recording sheet (hereinafter referred to as sheet) stored in a paper feeding cassette to a printing position (a transfer position) in order to print (transfer) an image on the sheet. In the image forming apparatus that prints a toner image on the sheet, the sheet on which an unfixed toner image is transferred in the transfer position is conveyed to a fixing device. When the sheet passes a fixing nip portion, the unfixed toner image is heated and pressed to be fixed on the sheet.

The sheet conveying device conveys the sheet to the transfer position with registration rollers to be timed to coincide with the start of conveyance by the registration rollers such that a leading end position of a toner image born on an image bearing member such as a photoconductive drum or an intermediate transfer belt or a transfer belt and the leading end of the sheet are aligned. When the sheet is conveyed, the sheet is put on standby with the leading end thereof set in contact with a nip portion of the registration rollers not rotating. The photoconductive drum or the intermediate transfer belt is driven with process speed, which is speed for performing image formation, set as circumferential speed. The registration rollers are driven to be timed to coincide with the timing when the leading end of an image on the intermediate transfer belt moving at the process speed reaches to the transfer position, and convey the sheet from the registration position to the transfer position at the process speed. Then, the leading end of the toner image and the leading end of the sheet are aligned in the transfer position. The toner image is accurately transferred onto the sheet.

When printing on plural sheets or printing of continuous pages is performed, image formation is performed with continuously fed sheets spaced apart from each other by an inter-sheet distance. Therefore, if the registration rollers are restarted at the process speed at the timing for starting registration, sheets are conveyed to the transfer position in printing after that while the inter-sheet distance is kept.

In the color image forming apparatus, for example, color toners of four colors, yellow (Y), magenta (M), cyan (C), and black (K), are born in order on the image bearing member such as the transfer belt. A sheet on which unfixed color toner images are transferred in the transfer position is conveyed to the fixing device and fixed on the sheet by pressing and heating. When a color image is continuously printed, it is desirable to set the inter-sheet distance as short as possible in order to secure fixability of the color toners. Further, if color printing speed (PPM: print per minute) is reduced, a heat quantity per one sheet can be secured. In this case, it is desired to realize a reduction in the inter-sheet distance and realize an increase in speed as much as possible, although the number of prints decreases.

As an image forming apparatus including a sheet conveying device that aligns the leading end of a toner image on an image baring member and the leading end of a sheet according a reduction in an inter-sheet distance, there is an image forming apparatus disclosed in JP-A-59-24870.

The image forming apparatus including the sheet conveying device in the past horizontally feeds a sheet in a paper feeding cassette directly to registration rollers with a paper feeding roller and horizontally conveys the sheet to a transfer position for transferring a toner image. The start of second and subsequent sheets by the registration rollers is controlled according to the registration start timing. An inter-sheet distance of sheets conveyed by the registration rollers to the transfer position at process speed is set as a normal inter-sheet distance. When the inter-sheet distance is set shorter than the normal inter-sheet distance, if the registration rollers are restarted at the registration start timing, at the time of the restart, a leading end position of the toner image is present further on the transfer position side than that in the case of the normal inter-sheet distance. Therefore, registration acceleration for conveying the sheet at sheet conveying speed by the registration rollers higher than the process speed is performed. When the leading end of the sheet catches up with the leading end of the toner image on the image bearing member that moves at the process speed, the sheet conveying speed by the registration rollers is reduced to the process speed to align the leading end of the toner image and the leading end of the sheet in the transfer position.

In the sheet conveying device in the past, the sheet fed from the paper feeding cassette to the registration rollers by the paper feeding roller is present in the paper feeding cassette and comes into contact with the paper feeding roller in a standby state in which the leading end of the sheet is in contact with the registration rollers. When the sheet conveying speed of the registration roller is reset to the process speed from the speed higher than the process speed, the sheet is still in contact with the paper feeding roller.

Therefore, after the sheet is fed to the registration rollers, driving to the paper feeding roller is disconnected and the paper feeding roller is idled by frictional contact with the sheet conveyed by the registration rollers to make it possible to convey the sheet. However, a load of sheet conveyance involved in the idling of the paper feeding roller is excessively applied to the registration rollers. Therefore, it is necessary to increase the power of a registration motor that drives the registration rollers.

However, when the sheet is conveyed by the registration rollers, because of the influence of a change in rigidity of the sheet due to the basis weight (thickness) of the sheet, an environment such as temperature and humidity, or the like, friction with a guide surface of a sheet conveyance guide increases, which becomes a load on sheet conveyance. This sheet conveyance load further increases according to an increase in the sheet conveying speed and causes a loss of synchronism of the registration motor and the conveying motors on the way.

If the speed of the registration acceleration is reduced to reduce the registration speed to the process speed immediately before transfer, the sheet conveyance load can be reduced. However, fluctuation in a load involved in the speed change occurs in the sheet and causes a blur and, in the case of a color image, causes color drift or the like.

On the other hand, in an image forming apparatus in which paper feeding cassettes are vertically arranged in plural stages, registration rollers are arranged on a sheet conveying path extending in an up to down direction and conveying rollers are arranged below the registration rollers to correspond to the paper feeding cassettes in the respective stages. A sheet in any one of the paper feeding cassettes is fed by the paper feeding roller to the conveying rollers corresponding thereto, conveyed to the registration rollers at conveying speed higher than process speed, and put on standby for restart for driving the registration rollers, which are temporarily stopped to drive sheet conveyance, again to perform sheet conveyance. In this case, depending on sheet length (sheet size) and a stage position of the paper feeding cassette, the sheet is nipped by at least the conveying rollers immediately below the registration rollers and waits for the restart of the registration rollers.

A driving mechanism for the conveying rollers and the paper feeding rollers includes a clutch mechanism. The driving mechanism turns off the clutch mechanism to thereby disconnect power transmission from driving motors to the conveying rollers and the paper feeding roller to allow the rollers to idle. In this case, even if it is attempted to convey the sheet to an upper transfer position with only the registration rollers according to a sudden change in speed such as the registration acceleration, stable sheet conveyance control is difficult because of the influence of the conveyance load and the like. Therefore, under the present situation, highly accurate positioning and conveyance of the sheet cannot be performed.

SUMMARY

It is an object of an aspect of the prevent invention to provide an image forming apparatus that can highly accurately position and convey, even if an inter-sheet distance of sheets to be conveyed is changed (reduced), the sheets from registration rollers to a transfer position.

According to an aspect of the present invention, in order to solve the problem described above, there is provided an image forming apparatus including: a sheet conveying path that conveys a sheet, which is fed from a paper feeding cassette by a paper feeding roller, to registration rollers with conveying rollers and conveys the sheet to a printing position with the registration rollers; a variable-speed registration motor that drives the registration rollers; a variable-speed conveyance motor that drives the conveying rollers; a variable-speed paper feeding motor that drives the paper feeding roller; and a control unit that performs driving control for the registration motor, the conveyance motor, and the paper feeding motor. The sheet conveying path has a conveying path portion, the conveying path portion having a distance between the registration rollers and an initial conveying roller to which the sheet is fed from the paper feeding roller that is shorter than a conveyed length of an A4 size sheet. The control unit has an inter-sheet reduction mode for setting sheet conveying speed by the registration rollers to different conveying speed in a period until the leading end of the sheet reaches the printing position. The control unit drives, in the inter-sheet reduction mode, the conveying rollers concurrently with sheet conveying speed during sheet conveyance by the registration rollers.

According to another aspect of the present invention, there is provided an image forming apparatus including: a sheet conveying path that conveys sheets, which are fed from paper feeding cassettes in plural stages by paper feeding rollers, to upper registration rollers with conveying rollers corresponding to the respective paper feeding cassettes and conveys the sheets to a printing position with the registration rollers; a variable-speed registration motor that drives the registration rollers; conveyance motors that drive the respective conveying rollers; paper feeding motors that drive the paper feeding rollers; and a control unit that performs driving control for the registration motor, the conveyance motors, and the paper feeding motors. The conveyance motors that drive the conveying rollers corresponding to at least the upper stage side paper feeding cassette are variable-speed motors. The control unit has an inter-sheet reduction mode for varying conveying speed of the sheets conveyed to the registration rollers according to a stage position of the paper feeding cassette selected from the paper feeding cassettes and a sheet size of a sheet to be fed and setting sheet conveying speed by the registration rollers to different conveying speed in a period until the leading end of the sheet reaches the printing position. The control unit drives, in the inter-sheet reduction mode, the conveying rollers concurrently with sheet conveying speed during sheet conveyance by the registration rollers.

According to still another aspect of the present invention, there is provided an image forming apparatus including: a sheet conveying path that conveys sheets, which are fed from paper feeding cassettes in plural stages by paper feeding rollers, to upper registration rollers with conveying rollers corresponding to the respective paper feeding cassettes and conveys the sheets to a printing position with the registration rollers; a variable-speed conveyance motor that drives the conveying rollers corresponding to the upper stage side paper feeding cassette; a clutch that engageably and disengageably transmits driving force of the paper feeding motor to the paper feeding roller corresponding to the lower stage side paper feeding cassette; a clutch that engageably and disengageably transmits driving force of the conveyance motor to the conveying rollers corresponding to the lower stage side paper feeding cassette; and a control unit that performs driving control for the registration motor, the clutches, the conveyance motor, and the paper feeding motors. The control unit has an inter-sheet reduction mode for varying conveying speed of the sheets conveyed to the registration rollers according to a stage position of the paper feeding cassette selected from the paper feeding cassettes and a sheet size of a sheet to be fed, setting the conveying speed of the conveying rollers to be common and a plurality of various conveying speeds in conveying the sheet from the conveying rollers corresponding to the lower stage side paper feeding cassette to the conveying rollers corresponding to the upper stage side paper feeding cassette, and setting sheet conveying speed by the registration rollers to different conveying speed in a period until the leading end of the sheet reaches the printing position. The control unit drives, in the inter-sheet reduction mode, the conveying rollers concurrently with sheet conveying speed by the registration rollers.

DETAILED DESCRIPTION

The present invention is explained below with reference to embodiments shown in the accompanying drawings.

Figure 1:
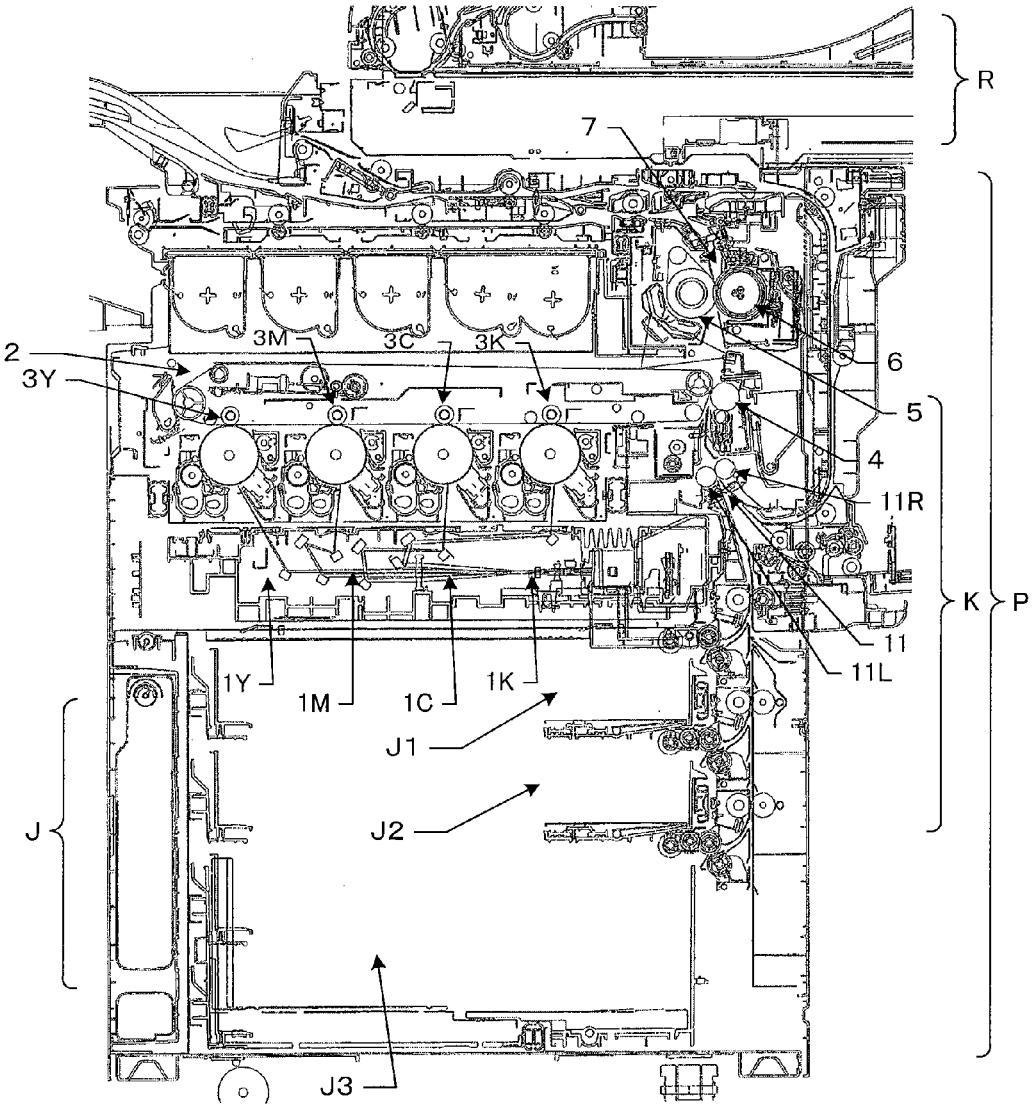
FIG. 1 is a longitudinal sectional view of a schematic configuration of an image forming apparatus according to a first embodiment of the present invention.
Figure 2:
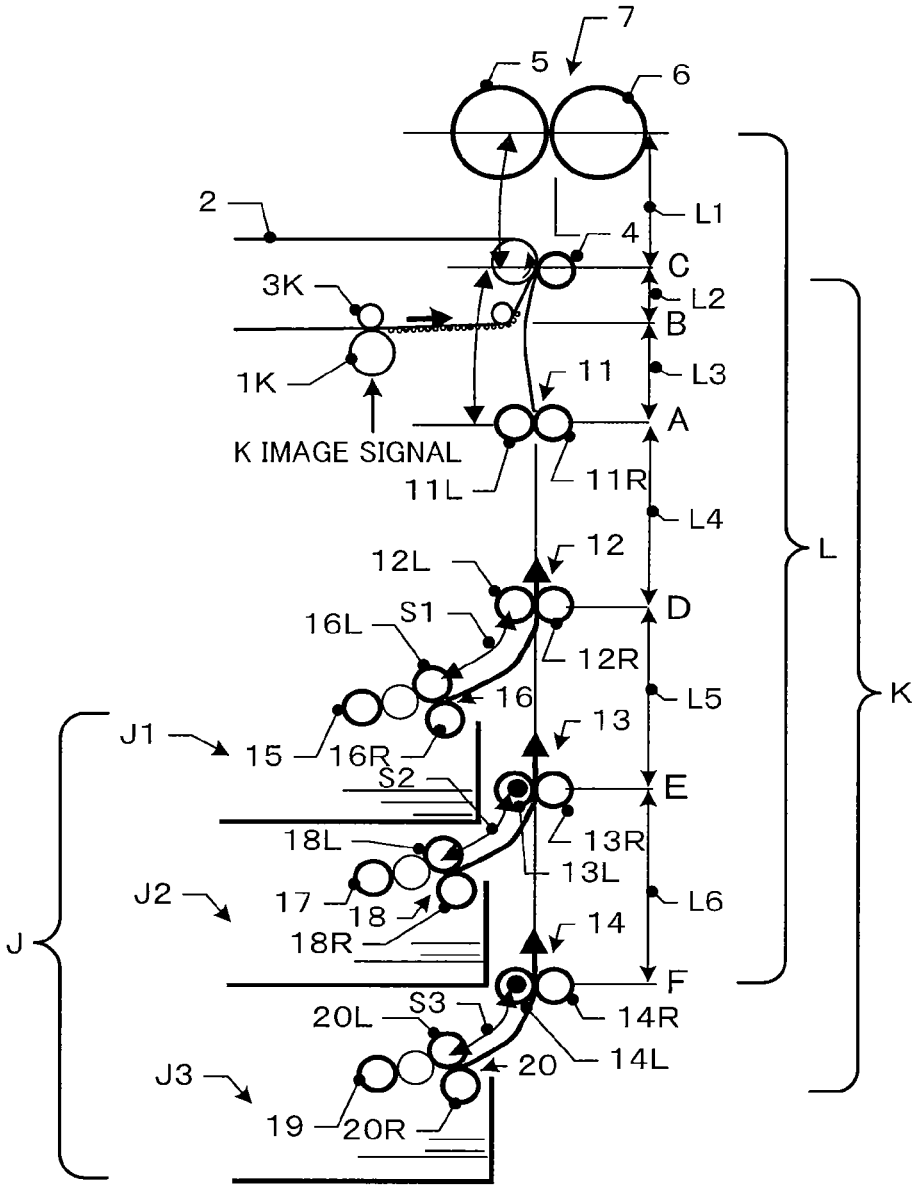
FIG. 2 is a schematic front view of a sheet conveying device of the image forming apparatus shown in FIG. 1.
Figure 3:
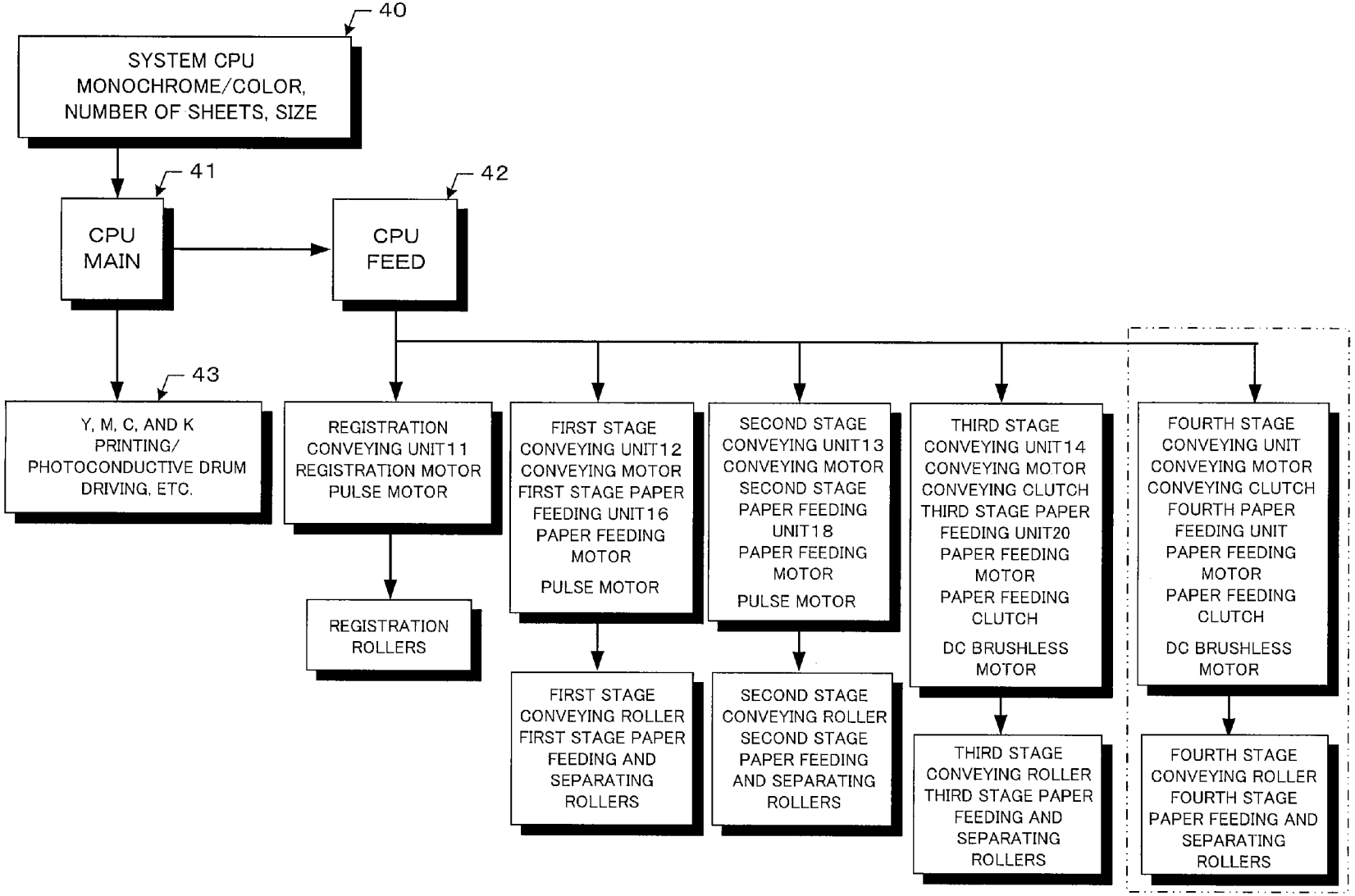
FIG. 3 is a control block diagram for explaining image formation and sheet conveyance in the image forming apparatus shown in FIG. 1.

FIG. 1 is a longitudinal sectional view of an image forming apparatus according to an embodiment of the present invention. FIG. 2 is a schematic front view of a sheet conveying device of the image forming apparatus shown in FIG. 1. FIG. 3 is a control block diagram of the sheet conveying device shown in FIG. 2.

As shown in FIG. 1, the image forming apparatus according to this embodiment has a configuration in which an image reading unit R and an image forming unit P are arranged in upper and lower sections. The image reading unit R scans and reads images of a sheet original document and a book original document.

The image forming unit P has a function of forming a developer image (a toner image) on a sheet on the basis of image information such as an image read from an original document by the image reading unit R or image data transmitted from an external apparatus to the image forming apparatus. In the image forming unit P, toner image forming units 1Y, 1M, 1C, and 1K including developing devices for colors, yellow (Y), magenta (M), cyan (C), and black (K), photoconductive drums corresponding to the developing devices for the respective colors, and laser exposing devices that irradiate image lights based on image signals of the respective colors on the photoconductive drums for the respective colors are arranged along an intermediate transfer belt 2.

Latent images formed on the photoconductive drums by the laser exposing devices are developed by the developing devices to obtain toner images. Toner images on the photoconductive drums for the respective colors are transferred onto an outer circumferential surface of the intermediate transfer belt 2 by primary transfer rollers 3Y, 3M, 3C, and 3K. The toner images on the intermediate transfer belt 2 superimposed by transferring the last black toner image are transferred onto a sheet in a secondary transfer position by a secondary transfer roller 4. When the sheet on which the unfixed toner images are transferred passes through a nip portion of a fixing device 7 including a heating roller 5 and a pressing roller 6, the unfixed toner images are melted by heating and pressing and fixed on the sheet.

Sheets are stacked and stored in paper feeding cassettes J arranged in plural stages in an up to down direction. The sheets in the paper feeding cassettes J are conveyed to the fixing device 7 through the secondary transfer position by a sheet conveying device K. The image forming apparatus shown in FIG. 1 includes the paper feeding cassettes J in three stages. However, the image forming apparatus may include paper feeding cassettes in two or four stages.

As shown in FIG. 2, in the sheet conveying device K, on a sheet conveying path L arranged on one side of the paper feeding cassettes J in plural stages and extending along the up to down direction, a registration conveying unit 11 in which a pair of registration rollers 11L and 11R are set in contact with each other, a first stage conveying unit 12 in which a pair of first stage conveying rollers 12L and 12R are set in contact with each other, a second stage conveying unit 13 in which a pair of second stage conveying rollers 13L and 13R are set in contact with each other, and a third stage conveying unit 14 in which a pair of third stage conveying rollers 14L and 14R are set in contact with each other are arranged. The sheet conveying path L extends upward from a registration position A, which is a contact nip portion of the pair of registration rollers 11L and 11R. The secondary transfer roller 4 is arranged in a secondary transfer position C. The heating roller 5 and the pressing roller 6 of the fixing device 7 are arranged in a press-contact state above the secondary transfer roller 4.

In this embodiment, a section from the nip portion of the heating roller 5 and the pressing roller 6 of the fixing device 7 to the secondary transfer position C is referred to as fixing and conveying path section L1. A section from the registration position A to a position (hereinafter referred to as acceleration end position) B a predetermined distance apart from the registration position A to the secondary transfer position C is referred to as acceleration conveying path section L3. A section between the acceleration end position B and the secondary transfer position C is referred to as process speed conveying path section L2.

A position of a nip portion of the pair of first stage conveying rollers 12L and 12R of the first stage conveying unit 12 is referred to as first stage conveyance position D. Positions of nip portions of the pair of second stage conveying rollers and the pair of third stage conveying rollers of the second stage conveying unit 13 and the third stage conveying unit 14 are referred to as second stage conveyance position E and third stage conveyance position F, respectively. A section between the registration position A and the first stage conveyance position D is referred to as first stage conveying path section L4. A section between the first stage conveyance position D and the second stage conveyance position E is referred to as second stage conveying path section L5. A section between the second stage conveyance position E and the third stage conveyance position F is referred to as third stage conveying path section L6.

Pickup rollers 15, 17, and 19 are arranged in paper feeding cassette housing units of the paper feeding cassettes J in three stages, respectively. The pickup rollers 15, 17, and 19 respectively pick up the sheets stored in the paper feeding cassettes J1 to J3 in the respective stages and send leading ends of the sheets into nip portions of a pair of a paper feeding roller 16L and a separating roller 16R, a pair of a paper feeding roller 18L and a separating roller 18R, and a pair of a paper feeding roller 20L and a separating roller 20R of a first stage paper feeding unit 16, a second stage paper feeding unit 18, and the third stage paper feeding unit 20 arranged in the front.

The first stage conveying unit 12 is located obliquely above the first stage paper feeding unit 16. The sheet passing through the nip portion of the pair of the paper feeding roller 16L and the separating roller 16R of the first stage paper feeding unit 16 is fed to the nip portion of the pair of conveying rollers 12L and 12R of the first stage conveying unit 12. The sheet is once conveyed to the registration position A, which is the nip portion of the pair of registration rollers 11L and 11R of the registration conveying unit 11, through the first stage conveying path section L4. At printing timing, the pair of registration rollers 11L and 11R are driven and the sheet is conveyed to the secondary transfer position C. A positional relation of the arrangement of the second stage paper feeding unit 18 and the second stage conveying unit 13 and a positional relation of the arrangement of the third stage paper feeding unit 20 and the third stage conveying unit 14 are the same as that of the first stage paper feeding unit 16 and the first stage conveying unit 12.

The sheet fed from the third stage paper feeding cassette J3 to the third stage conveying unit 14 by the third stage paper feeding unit 20 is once conveyed from the third stage conveying path section L6 to the registration position A of the registration conveying unit 11 through the second stage conveying path section L5 and the first stage conveying path section L4 and, at the printing timing, conveyed to the secondary transfer position C. Similarly, the sheet in the second stage paper feeding cassette J2 is fed from the second stage paper feeding unit 18 to the second stage conveying unit 13, conveyed from the second stage conveying path section L5 through the first stage conveying path unit L4, and once conveyed to the registration position A of the registration conveying unit 11. The sheet in the first stage paper feeding cassette J1 is conveyed from the first stage paper feeding unit 16 through the first stage conveying path section L4, once conveyed to the registration position A of the registration conveying unit 11, and, at the printing timing, conveyed to the secondary transfer position C.

A section between the first stage conveyance position D of the first stage conveying unit 12 and the nip portion of the pair of the paper feeding roller 16L and the separating roller 16R of the first stage paper feeding unit 16 is referred to as first stage paper feeding path section S1. Similarly, a section between the second stage conveyance position E and the nip portion of the pair of the paper feeding roller 18L and the separating roller 18R of the second stage paper feeding unit 18 is referred to as second stage paper feeding path section S2. A section between the third stage conveyance position F and the nip portion of the pair of the paper feeding roller 20L and the separating roller 20R of the third stage paper feeding unit 20 is referred to as third stage paper feeding path section S3. The paper feeding roller and pick-up roller as described later are motor driven by one-way clutch t.

Pulse motors as variable-speed motors are respectively used as conveying motors in the first stage conveying unit 12 and the second stage conveying unit 13. The conveying motors speed-variably drive the pair of first stage conveying rollers 12L and 12R and the pair of second stage conveying rollers 13L and 13R and make it possible to change sheet conveying speed in the first stage conveying path section L4 and the second stage conveying path section L5.

A DC brushless motor which is able to change the speeds is used as a conveying motor for the third stage conveying unit 14. The output of the DC brushless motor is transmitted to the third stage conveying rollers 14L and 14R by an engageable and disengageable conveying clutch (which can be turned on and off) via an electromagnetic solenoid or the like. In this embodiment, sheet conveying speed of the third stage conveying path section L6 by the third stage conveying unit 14 is set to the low-speed conveying speed (V1) based on process speed (Vp) and is able to change to the high-speed conveying speed (V2) that is faster than the low-speed conveying speed (V1). When the clutch is switched to OFF, a transmission of the driven force to the third stage conveying rollers 14L and 14R are disable. The low-speed conveying speed (V1) can set a plurality of various speeds according to the stage position of the cassette and so on.

On the other hand, pulse motors as variable-speed motors are used as paper feeding motors in the first stage paper feeding unit 16 and the second stage paper feeding unit 18. The paper feeding motors speed-variably drive the pair of the first stage paper feeding roller 16L and the separating roller 16R and the pair of the second stage paper feeding roller 18L and the separating roller 18R. Therefore, it is possible to change paper feeding speed in the first stage paper feeding path section S1 and the second stage paper feeding path section S2 to be adjusted to variable speed in the first stage conveying path section L4 and the second stage conveying path section L5.

Like the driving mechanism for the third stage conveying unit 14, a driving mechanism for the third stage paper feeding unit 20 has a configuration attached with a clutch in which a DC brushless motor is used as a paper feeding motor. The driving mechanism drives the pair of the third stage paper feeding roller 20L and the separation roller 20R so as to be able to change the speed to the low-speed conveying speed (V1) and high-speed conveying speed (V2) and causes the rollers to convey the sheet in the third stage paper feeding cassette J3 from the third stage paper feeding path section S3 to the third stage conveying path section L6 at the low-speed conveying speed (V1) or high-speed conveying speed (V2). The pickup rollers 15, 17, and 19 receive the transmission of the driving force of the first stage paper feeding roller 16L, the second stage paper feeding roller 18L, and the third stage paper feeding roller 20L adjacent thereto, respectively to rotate.

A pulse motor as a variable-speed motor is used as a registration motor in the registration conveying unit 11. The registration motor speed-variably rotates the pair of registration rollers 11L and 11R. The pair of registration rollers 11L and 11R convey, according to the driving by the registration motor as the pulse motor, the sheet put on standby for printing timing in the registration position A through the acceleration conveying path section L3 at conveying speed higher than the process speed and convey the sheet to the secondary transfer position C through the process speed conveying path section L2 at the process speed. The leading end of the sheet passing the secondary transfer position C enters the nip portion of the heating roller 5 and the pressing roller 6, which rotate at circumferential speed equal to the process speed, of the fixing device 7 and fixing of an image is performed. After the trailing end of the sheet passes the registration position A, the driving of the registration motor is stopped.

When sheet conveying speed for conveying the sheet to the registration position A is the process speed, when the sheet is conveyed to the registration position A at speed higher than the process speed, and when the sheet put on standby in the registration position A is conveyed through the acceleration conveying path section L3 at high speed, depending on the length in the conveying direction of the sheet, the first and second stage conveying units 12 and 13 and the first and second stage paper feeding units 16 and 18 are rollers that resist the conveyance of the sheet. Therefore, variable-speed pulse motors are used as motors for the conveying units and the paper feeding units to apply conveying force to the sheet according to a speed change to prevent the conveying units and the paper feeding units to resist the conveyance. First stage paper feeding unit 16 and second stage paper feeding unit 18 stop the paper feeding motors and prepare to the next paper feeding, when the sheet is conveyed to corresponding the conveying motors 12 and 13 at the paper feeding speed faster than the process speed, so that the sheet can be drawingly conveyed by the action of the one-way clutch.

In this embodiment, timing for restarting the sheet put on standby in the registration position A for starting registration is, for example, predetermined time (registration start timing time) after a black (K) image signal is output to the photoconductive drum of the toner image forming unit 1K for black. The sheet is conveyed from the registration position A to the secondary transfer position C at the process speed adjusted to the timing when the leading end of an image on the intermediate transfer belt 2 moving at the process speed reaches to the secondary transfer position C. The leading end of the sheet and the leading end of the image on the intermediate transfer belt 2 are matched in the secondary transfer position C.

For example, when an inter-sheet distance in color continuous printing (transfer) is changed to be shorter than a normal inter-sheet distance (hereinafter referred to as inter-sheet reduction mode), output timing for images signals of the respective colors is set earlier by time corresponding to the length of the reduction. In the inter-sheet reduction mode, when the registration start timing time comes, the sheet is conveyed at an acceleration mode of speed higher than the process speed until the leading end of the sheet reaches the acceleration end position B. Thereafter, the conveying speed of the sheet is reset to the process speed. In this way, the leading end of the sheet in the secondary transfer position C is matched to the leading end of the image on the intermediate transfer belt 2.

In this embodiment, the inter-sheet reduction mode can be applied, for example, in the case of color continuous printing. In the color continuous printing, when a sheet size (A4/LT or A4R) with small conveying length is selected, the inter-sheet reduction mode can be applied regardless of whether the sheet is stored in the first stage paper feeding cassette J1, the second stage paper feeding cassette J2, or the third stage paper feeding cassette J3. On the other hand, when a sheet size (A3/LD) with large conveying length is selected, the inter-sheet reduction mode is not applied regardless of the number of stages of paper feeding cassettes.

In the inter-sheet reduction mode, when a color image is printed on the sheet stored in the first stage paper feeding cassette J1, pulses in the acceleration mode are simultaneously output to the pulse motor of the first stage conveying unit 12 in addition to the pulse motor of the registration conveying unit 11 to apply conveying force to the sheet in two places in the conveying direction with conveying speed of acceleration and deceleration and convey the sheet.

After the end of the sheet conveyance in the acceleration mode, the pulse motor of the registration conveying unit 11 and the pulse motor of the first stage conveying unit 12 are driven at the process speed to apply conveying force to the sheet in two places in the conveying direction with the process speed and convey the sheet to the secondary transfer position C. In this way, when the sheet put on standby in the registration position A is restarted to the secondary transfer position C, the sheet conveying speed of the first stage conveying unit 12 can be adjusted to the conveying speed of acceleration and deceleration by the registration rollers 11L and 11R and can be further adjusted to the process speed. Therefore, it is possible to highly accurately position and convey the sheet from the acceleration end position B to the secondary transfer position C without being affected by a conveyance load of the sheet.

When the sheet in the second stage paper feeding cassette J2 is conveyed in the inter-sheet reduction mode, the second stage conveying unit 13 is controlled to be driven in addition to the conveyance of the sheet in the first stage paper feeding cassette J1 explained above so as to convey the sheet according to the restart of registration and convey the sheet to the registration position A at high speed.

When the sheet in the third stage paper feeding cassette J3 is conveyed, the length of the conveying path L is set such that the trailing end of the sheet is held by the nip portion of the paper feeding roller 20L and the separating roller 20R of the third stage paper feeding unit 20 when registration of the sheet with large conveying length (A3/LD) is restarted. Therefore, a conveying motor for the third stage conveying unit 14 and the paper feeding motor for the third stage paper feeding unit 20 are set to the low-speed conveying speed (V1) based on process speed (Vp) and as DC brushless motors which is changeable to the high-speed conveying speed (V2) faster than the low-speed conveying speed (V1).

When, for example, the A4-R sheet is stored in the third stage paper feeding cassette J3 and conveyed in the inter-sheet reduction mode, since the third stage conveyance position F is apart from the registration position A, it is necessary to convey the sheet to the registration position A at as high conveying speed as possible.

When, for example, the A3 sheet is stored in the third stage paper feeding cassette J3 and conveyed without using the inter-sheet reduction mode, the sheet is conveyed at the process speed.

In this embodiment, a reason for not applying the inter-sheet reduction mode to the sheet with large sheet conveying length such as the A3/LD size is as explained below.

As sheet conveying length is larger, it is likely that a sheet conveyance load received from the sheet conveyance guide or the like increase and a sheet cannot be conveyed with enough sheet conveying force. In particular, if conveying speed increases, the sheet conveyance load increases. Since load fluctuation in sheet conveyance is affected by uncertain factors such as a high-humidity environment and a storage state of sheets immediately before printing, a sufficient torque margin of the motors is necessary.

On the other hand, an inter-sheet distance in continuous printing for the sheet with large conveying length (A3/LD) is set longer than the inter-sheet distance in the continuous printing for the sheet with small conveying length (A4/LT). This relation would be easily understood by comparing the numbers of prints per unit time. For example, since the conveying length of the A3 sheet is twice as large as the conveying length of the A4 sheet, the number of continuous prints of the A4 sheet is twice as large as the number of continuous prints of the A3 sheet. Therefore, an inter-sheet distance of the A3 continuous printing is twice as large as an inter-sheet distance of the A4 continuous printing. When the conveying length of the A4 sheet is represented as "a" and the inter-sheet distance thereof is set as "a", in time same as time (equivalent to conveying length 4*a*) required immediately before a third A4 sheet is conveyed after first and second A4 sheets are conveyed, a conveyance state of the A3 sheet with conveying length 2*a* is a state immediately before a second A3 sheet is conveyed after a first A3 sheet is conveyed. Therefore, an inter-sheet distance of the A3 sheet is 2*a*.

In this way, the inter-sheet distance of the A3 sheet is twice as large as the inter-sheet distance of the A4 sheet. Therefore, when it is attempted to reduce an inter-sheet distance, it is necessary to double speed for acceleration in the acceleration conveying path section L3. This is unrealistic. Conversely, since there is a temporal margin for conveying the A3 sheet to the registration position A because the inter-sheet distance is long, it is possible to convey the A3 sheet at the process speed rather than high speed. In terms of image fixing, a heat quantity deprived by a sheet per fixed time is the same in the A4 size and the A3 size.

Therefore, the inter-sheet reduction mode is not applied to the sheet with large sheet conveying length such as the A3/LD size.

Consequently, it can also be said that the reduction in an inter-sheet distance is realized in this embodiment in order to eliminate the influence on fixability of color toners due to the increase in the inter-sheet distance caused by a reduction in the number of prints per unit time.

In the following explanation of this embodiment, the length of the fixing and conveying path section L1 is set to 90 mm, the length of the process speed conveying path section L2 is set to 20 mm, the length of the acceleration conveying path section L3 is set to 60 mm, the length of the first stage conveying path section L4, the length of the second stage conveying path section L5, and the length of the third stage conveying path section L6 are set to 110 mm, and the length of the first stage paper feeding path section S1, the length of the second stage paper feeding path section S2, and the length of the third stage paper feeding path section S3 are set to 70 mm.

A distance from the first stage paper feeding unit 16 corresponding to the first stage paper feeding cassette J1 to the second transfer position C is S1+L4+L3+L2=260 mm, which exceeds the conveying length 210 mm of the A4 size sheet and the conveying length 216 mm of the LT size sheet. Therefore, it is possible to accelerate the sheet from the registration restart until the leading end of the sheet reaches the acceleration end position B in the inter-sheet reduction mode and change the sheet conveying speed to the process speed before the transfer in the secondary transfer position C. Since the conveying speed is changed to the process speed 20 mm before the secondary transfer position C, the leading end of the sheet comes into contact with the intermediate transfer belt 2 without giving impact thereon at the secondary transfer position C. It is possible primarily transfer toner images onto the intermediate transfer belt 2 from the photoconductive drums for the respective colors without irregularity and irradiate image light from the laser exposing device on the photoconductive drums without irregularity.

In the second stage paper feeding cassette J2, a distance from the second stage paper feeding unit 18 to the registration position A is S2+L5+L4=280 mm, a distance from the second stage paper feeding unit 18 to the secondary transfer position C is S2+L5+L4+L3++L2=370 mm, and a distance to the acceleration end position B is 350 mm, which exceed the conveying length 210 mm of the A4 size sheet and the conveying length 216 mm of the LT size sheet. Therefore, sheet conveyance in the inter-sheet reduction mode is possible.

In the third stage paper feeding cassette J3, a distance from the third stage paper feeding unit 20 to the registration position A is S3+L6+L5+L4=400 mm, which is smaller than the conveying length 420 mm of the A3 size sheet and the conveying length 432 mm of the LD size sheet.

Therefore, in the sheet conveyance to the registration position A and the registration restart, a conveyance load of the sheet due to a load on the paper feeding roller 20L and the separating roller 20R of the third stage paper feeding unit 20, a shape of a sheet conveyance guide, and the like increases. Therefore, the conveying speed of the third stage conveying unit 14 and the conveying speed of the third stage paper feeding unit 20 are set to be changeable to the low-speed conveying speed (V1) and high-speed conveying speed (V2) according to the size of the sheet to realize smooth sheet conveyance. When the A3 or LD size sheet is conveyed from the third stage paper feeding cassette J3 to the registration position A, it is also conceivable to turn off the clutch of the third stage conveying unit 14 to allow the third stage conveying rollers 14L and 14R to idle or slightly shift timing for turning off the clutch to drive the third stage conveying rollers 14L and 14R only at an instance. However, it is likely that fluctuation in a load caused when the clutch is off is applied to the pulse motors of the registration conveying unit 11, the first stage conveying unit 12, and the second stage conveying unit 13 and causes a loss of synchronism of the pulse motors. On the other hand, a conveyance load of the sheet can be reduced by shifting the timing to stop and making a slight slack of the conveyed sheet. For example, an amount of time to shift the sheet can be 10 to 20 mm sec.

When registration acceleration is performed in the registration restart, the clutch of the third stage conveying unit 14 is turned off at acceleration timing of the registration acceleration to allow the third stage conveying rollers 14L and 14R to stop the sheet conveyance. However, it is likely that fluctuation occurs in timing of deceleration of the pulse motors of the registration conveying unit 11, the first stage conveying unit 12, and the second stage conveying unit 13 and OFF control of the clutch and, in particular, a delay in clutch OFF increases the slack of a conveyed sheet. Therefore, both the sheet conveying speed for the sheet in the third stage paper feeding cassette J3 and the speed of the registration restart are set to the low-speed conveying speed (V1) and do not perform the registration acceleration.

On the other hand, when the A4-R size sheet (conveying length is 297 mm) is stored in the third stage paper feeding cassette J3, a distance from the registration position A to the third stage conveyance position F is 330 mm. When the leading end of the sheet reaches the second stage conveyance position D, the trailing end of the sheet is present closer to the pickup roller 19 side by 9 mm from the nip portion of the third stage paper feeding roller 20L and the third stage separating roller 20R of the third stage paper feeding unit 20. Therefore, the third stage conveying unit 14 and the third stage paper feeding unit 20 are driven at the high-speed conveying speed (V2) and the conveying speed of the first stage conveying unit 12 and the second stage conveying unit 13 is set to the high-speed conveying speed (V2). This makes it possible to convey a sheet equal to or smaller than the A4-R size in the third stage paper feeding cassette J3 distant from the registration position A to the registration position A at high speed and secure a temporal margin until the registration restart.

As shown in FIG. 3, in image forming processing and sheet conveying processing, according to operation of an operation panel or the like of the image forming apparatus, selection information such as monochrome or color, the number of prints, a sheet size, a stage number of a paper feeding cassette, and plain paper or thick paper, and the like and a start signal are input to a system CPU 40 that controls the entire image forming apparatus. The system CPU 40 transmits these kinds of selection information to a main CPU 41. The main CPU 41 transmits information concerning sheet conveyance to a sheet conveyance CPU 42 and instructs the toner image forming units 1Y, 1M, 1C, and 1K and the like to perform image forming operation.

The sheet conveyance CPU 42 instructs the registration motor of the registration conveying unit 11 as the pulse motor, the conveying motor of the first stage conveying unit 12 and the paper feeding motor of the first stage paper feeding unit 16 as the pulse motors, and the conveying motor of the second stage conveying unit 13 and the paper feeding motor of the second stage paper feeding unit 18 as the pulse motors to perform driving operation. The first stage conveying roller of the first stage conveying unit 12 and the second stage conveying roller of the second stage conveying unit 13 and the paper feeding and separating rollers of the first stage paper feeding unit 16 and the second stage paper feeding unit 18 change paper feeding speed and conveying speed according to the operation of the sheet conveyance CPU 42.

The sheet conveyance CPU 42 instructs the conveying motor of the third stage conveying unit 14 and the paper feeding motor of the third stage paper feeding unit 20 as the DC brushless motors to perform driving operation and instructs the conveying clutch of the third stage conveying unit 14 and the paper feeding clutch of the third stage paper feeding unit 20 to perform ON and OFF operation.

The third stage conveying roller of the third stage conveying unit 14 and the paper feeding and separating rollers of the third stage paper feeding unit 20 can be driven to rotate or can idle at the fixed process speed according to the operation of the sheet conveyance CPU 42.

The paper feeding cassettes can be provided in four stages. A forth stage paper feeding cassette can be arranged below the third stage paper feeding cassette J3. When the fourth stage paper feeding cassette is arranged, a configuration of a fourth stage conveying unit and a fourth stage paper feeding unit is the same as the configuration of the third stage conveying unit 14 and the third stage paper feeding unit 20.

Figure 4:
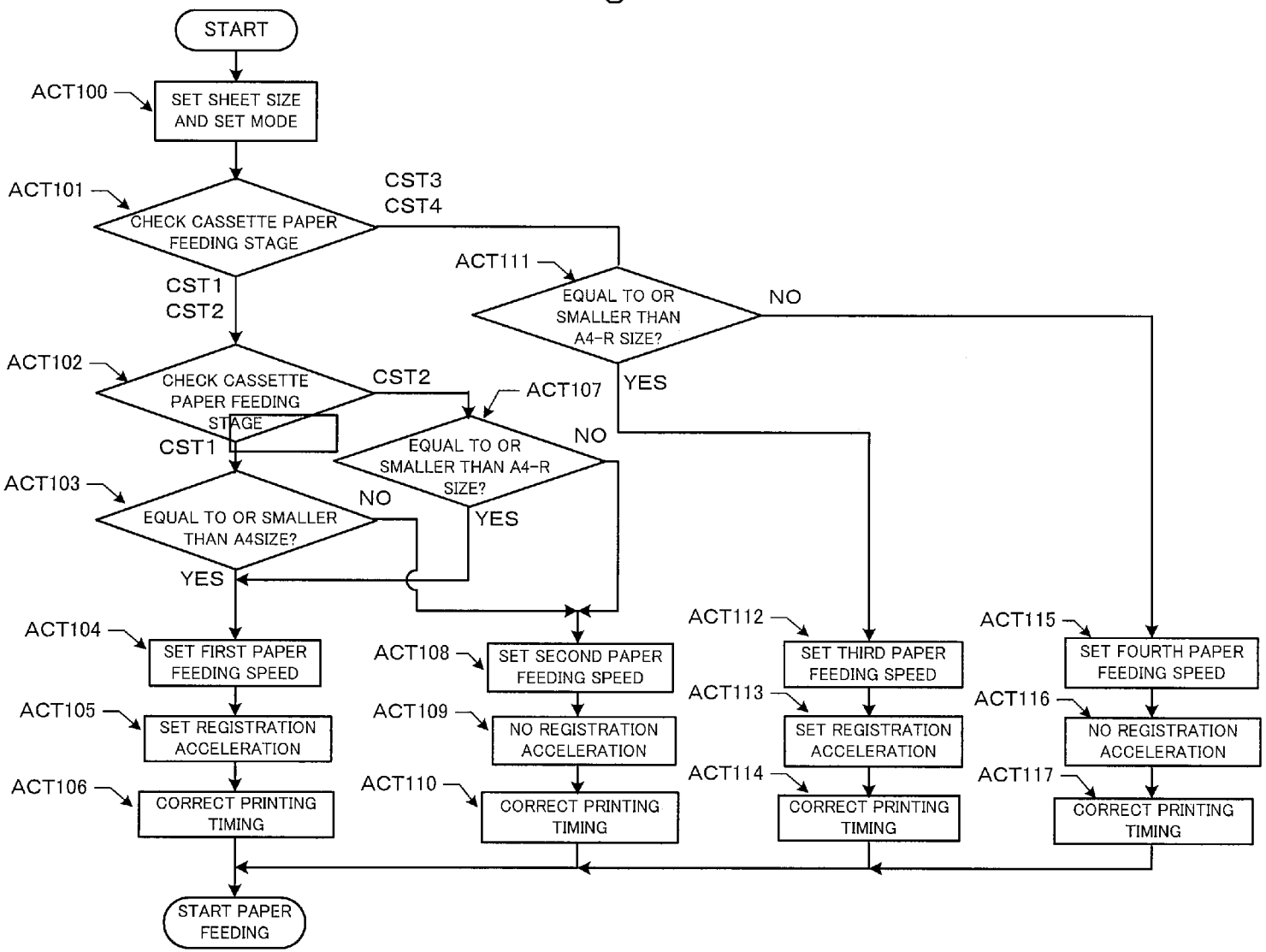
FIG. 4 is a flowchart of a flow of paper feeding and conveying operation by control blocks shown in FIG. 3.

The operation of the sheet conveyance CPU 42 is explained with reference to a flowchart shown in FIG. 4 and speed charts of sheet conveyance shown in FIGS. 5 to 10. Vp is the process speed, V1 is the low-speed conveying speed based on the process speed (Vp), and V2 is the high-speed conveying speed which is faster than the low-speed conveying speed V1.

In the operation of the sheet conveyance CPU 42, first, in ACT 100, the sheet conveyance CPU 42 performs mode setting for color or monochrome, a sheet size, and plain paper or thick paper, and the like. In ACT 101, the sheet conveyance CPU 42 checks a stage number of a selected paper feeding cassette. In the following explanation, it is assumed that a continuous printing mode is selected in color image formation. When the stage number of the paper feeding cassette is a first stage paper feeding cassette (CST1) or a second stage paper feeding cassette (CST2), the sheet conveyance CPU 42 proceeds to ACT 102. When the stage number of the paper feeding cassette is a third stage paper feeding cassette (CST3) or a fourth stage paper feeding cassette (CST4), the sheet conveyance CPU 42 proceeds to ACT 111.

When the stage number of the paper feeding cassette is CST1 in ACT 102, the sheet conveyance CPU 42 proceeds to ACT 103. When the stage number of the paper feeding cassette is CST2, the sheet conveyance CPU 42 proceeds to ACT 107.

In ACT 103, the sheet conveyance CPU 42 determines whether a sheet size of sheets stored in the CST1 is equal to or smaller than the A4 size. When the sheet size is equal to or smaller than the A4 size, in ACT 104, the sheet conveyance CPU 42 sets first conveying speed and proceeds to ACT 105. On the other hand, when the paper feeding cassette is the CST2, in ACT 107, the sheet conveyance CPU 42 determines whether a sheet size of sheets stored in the CST2 is equal to or smaller than the A4-R size (conveying length is 297 mm). When the sheet size of sheets stored in the CST2 is equal to or smaller than the A4-R size, the sheet conveyance CPU 42 proceeds to ACT 104 and sets first paper feeding and conveying speed. The length from the registration position A to the paper feeding roller 18L of the second stage paper feeding cassette J2 is 290 mm. In the case of the A4-R sheet size, the trailing end of a sheet slightly extends beyond the length (by 7 mm). Therefore, even if the registration rollers 11L and 11R are driven in the inter-sheet reduction mode, since conveyance resistance in the paper feeding cassette can be neglected, the A4-R size sheet can be highly accurately registration-conveyed.

In ACT 105, the sheet conveyance CPU 42 sets, for the inter-sheet reduction mode, registration acceleration speed (acceleration and deceleration speed) to the acceleration end position and process speed to the secondary transfer position C and proceeds to ACT 106. In ACT 106, the sheet conveyance CPU 42 corrects printing timing for a toner image transferred onto the intermediate transfer belt 2 and starts paper feeding.

Figure 5:
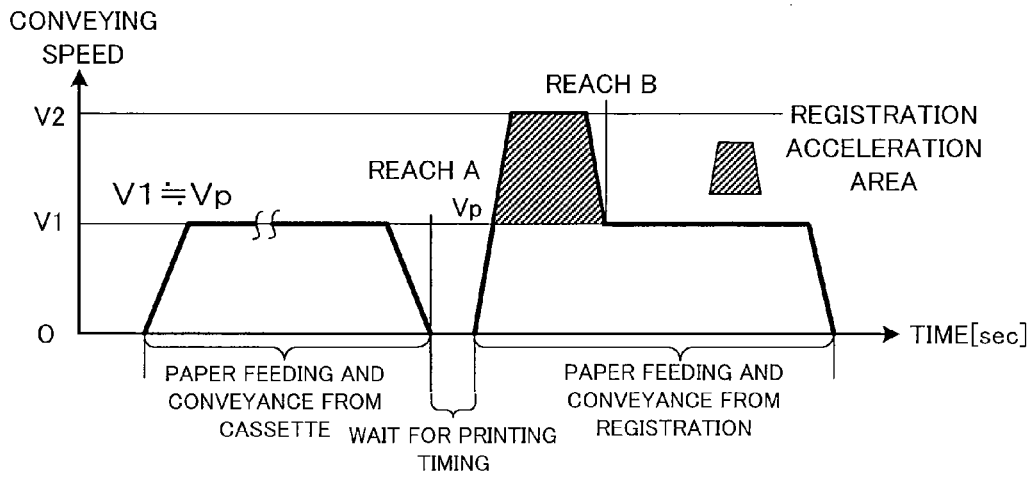
FIG. 5 is a speed chart of a first sheet in feeding and conveyance of sheets of a size, which can be registration-accelerated, stored in a first stage paper feeding cassette or a second stage paper feeding cassette.
Figure 6:
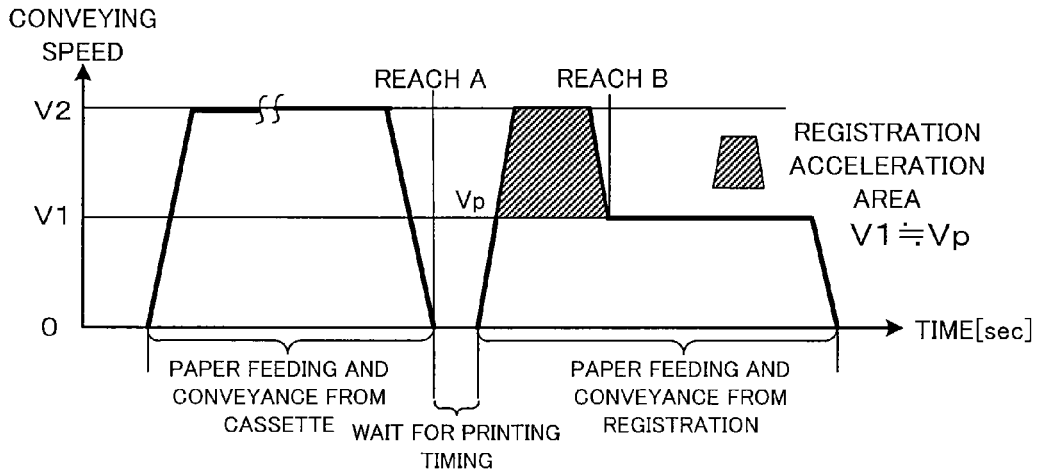
FIG. 6 is a speed chart of second and subsequent sheets in feeding and conveyance of the sheets of a size, which can be registration-accelerated, stored in a first stage paper feeding cassette or a second stage paper feeding cassette.

FIGS. 5 and 6 are speed charts of conveying speed for A4 size sheets stored in the CST1 or the CST2 from the paper feeding cassette to the registration position A and conveying speed from the registration position A in the inter-sheet reduction mode. FIG. 5 is a speed chart of sheet conveyance of a first sheet. FIG. 6 is a speed chart of sheet conveyance of second and subsequent sheets. The first sheet is conveyed to the registration position A at the low-speed conveying speed (V1) and conveyed at printing timing until the leading end of the first sheet reaches the acceleration end position B at the high-speed conveying speed (V2).

In the case of continuous printing on the sheet in the CST1, when sheet conveyance by the registration rollers is started, the first stage conveying unit 12 is controlled to be driven at conveying speed adjusted to the speed of the registration motor. When the trailing end of the sheet passes the first stage conveying unit 12, the motor therefor is stopped. The registration motor is controlled to be driven until the trailing end of the sheet passes the registration position A. In inter-sheet reduction, the first sheet may be conveyed from the registration position A at the low-speed conveying speed (V1). However, the first sheet is accelerated at the high-speed conveying speed (V2) in order to check a conveyance state such as skew of the sheet and obtain an amount of time to correct during sheet conveyance of the second and subsequent sheets.

In the conveyance of the second and subsequent sheets, as shown in FIG. 6, the sheet in the paper feeding cassette is conveyed to the registration position A at the high-speed conveying speed (V2) such that the sheet reaches the registration position A early enough. The sheet is conveyed at the process speed (Vp) at the printing timing until the leading end of the sheet reaches from the registration position A to the acceleration end position B. Thereafter, the registration rollers convey the sheet at the low-speed conveying speed (V1) until the trailing end of the sheet passes the registration position A. The pulse motors of the first stage conveying unit 12 and the registration conveying unit 11 are controlled at the low-speed conveying speed (V1) and the high-speed conveying speed (V2) according to driving timing shown in FIG. 6 until the trailing end of the sheet passes.

Referring back to FIG. 4, when it is determined in ACT 103 or ACT 107 that the sheet size of the sheets stored in the CST1 is longer than the A4-R size, the sheet conveyance CPU 42 proceeds to ACT 108.

In ACT 108, when the sheet size of the selected CST1 or CST2 is, for example, A3, the sheet conveyance CPU 42 sets second paper feeding and conveying speed for feeding and conveying the sheet to the registration position A and proceeds to ACT 109.

In ACT 109, since an inter-sheet distance is a normal inter-sheet distance, the sheet conveyance CPU 42 sets "no registration acceleration" for not performing the registration acceleration and proceeds to ACT 110. In ACT 110, the sheet conveyance CPU 42 performs printing timing correction as in ACT 106 and starts paper feeding.

Figure 7:
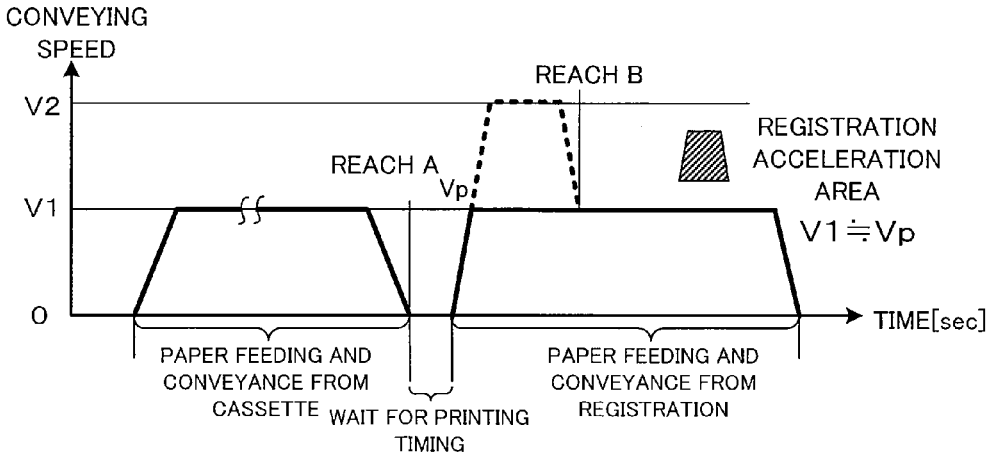
FIG. 7 is a speed chart of a first sheet in feeding and conveyance of sheets of a size, which cannot be registration-accelerated, stored in the first stage paper feeding cassette or the second stage paper feeding cassette.
Figure 8:
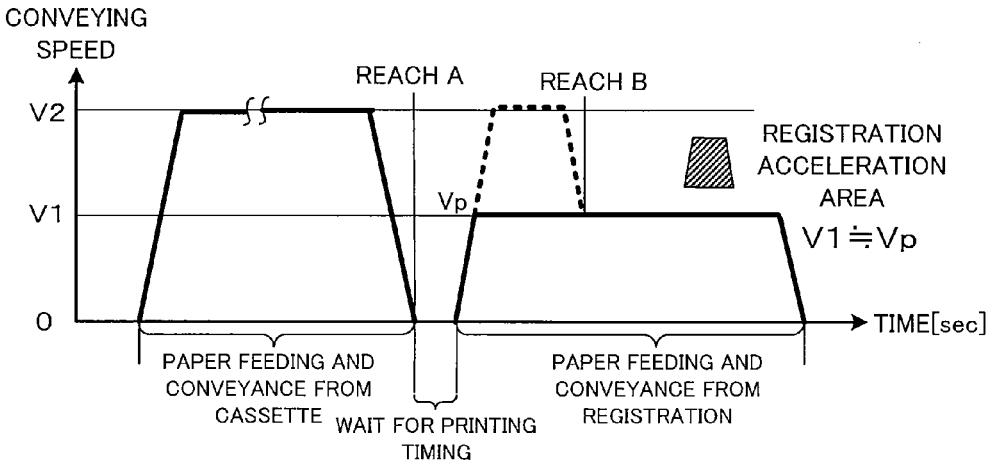
FIG. 8 is a speed chart of second and subsequent sheets in feeding and conveyance of the sheets of a size, which cannot be registration-accelerated, stored in the first stage paper feeding cassette or the second stage paper feeding cassette.

FIGS. 7 and 8 are speed charts of, in continuous conveyance of A3 size sheets stored in the CST1 or the CST2, conveying speed from the paper feeding cassette to the registration position A and conveying speed from the registration position A. In this case, an inter-sheet distance is set to a normal inter-sheet distance. FIG. 7 is a speed chart of sheet conveyance of a first sheet. FIG. 8 is a speed chart of sheet conveyance of second and subsequent sheets. The first sheet is conveyed to the registration position A at the low-speed conveying speed (V1) and conveyed at the printing timing at the process speed (Vp).

In the continuous printing on the sheets in the CST1, when sheet conveyance by the registration rollers is started, the first stage conveying unit 12 is controlled to be driven at paper feeding and conveying speed adjusted to the speed of the registration motor. When the trailing end of the sheet passes the first stage conveying unit 12, driving of the motor therefor is stopped. The registration motor is controlled to be driven until the trailing end of the sheet passes the registration position A.

In the conveyance of the second and subsequent sheets, as shown in FIG. 8, the sheet in the paper feeding cassette is conveyed to the registration position A at the high-speed conveying speed (V2) such that the sheet reaches the registration position A early enough. The sheet is conveyed at printing timing at the process speed (Vp) until the trailing end of the sheet passes the registration position A. The pulse motors of the first stage conveying unit 12 and the registration conveying unit 11 are controlled at the low-speed conveying speed (V1) and the high-speed conveying speed (V2) according to driving timing shown in FIG. 8 until the trailing end of the sheet passes.

Referring back to FIG. 4, when the paper feeding cassette selected in ACT 101 is the third stage paper feeding cassette (CST3) or the fourth paper feeding cassette (CST4), in ACT 111, the sheet conveyance CPU 42 determines whether a sheet size of sheets stored in the selected paper feeding cassette is equal to or smaller than the A4-R size. When the sheet size is equal to or smaller than the A4-R size, the sheet conveyance CPU 42 proceeds to ACT 112.

In ACT 112, when the sheet size of the selected CST3 or CST4 is, for example, the A4-R size (conveying length is 297 mm), the sheet conveyance CPU 42 sets the second paper feeding and conveying speed for feeding and conveying the sheet to the registration position A and proceeds to ACT 113.

In ACT 113, the sheet conveyance CPU 42 sets the registration acceleration as in ACT 105. In ACT 114, the sheet conveyance CPU 42 performs printing timing correction and starts paper feeding and conveyance.

When the sheet size is equal to or larger than the A4-R size, for example, the A3 size (conveying length is 420 mm) in ACT 111, the sheet conveyance CPU 42 proceeds to ACT 115.

In ACT 115, the sheet conveyance CPU 42 sets fourth paper feeding and conveying speed and proceeds to ACT 116.

In ACT 116, since continuous printing in the normal inter-sheet distance is performed, the sheet conveyance CPU 42 sets "no registration acceleration" as in ACT 109. In ACT 117, the sheet conveyance CPU 42 performs printing timing correction and starts paper feeding.

Figure 9:
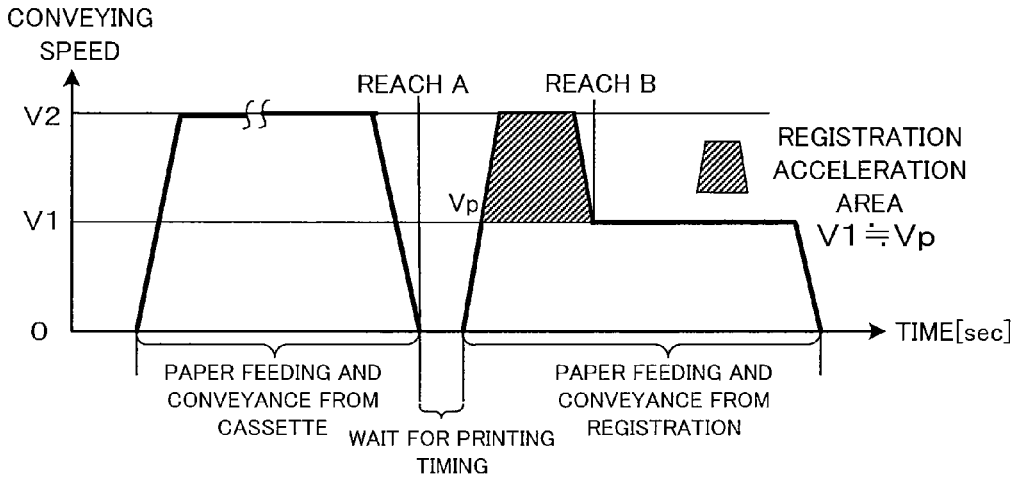
FIG. 9 is a speed chart in feeding and conveyance of sheets of a size equal to or smaller than A4-R, which can be registration-accelerated, stored in a third stage paper feeding cassette or a fourth stage paper feeding cassette.
Figure 10:
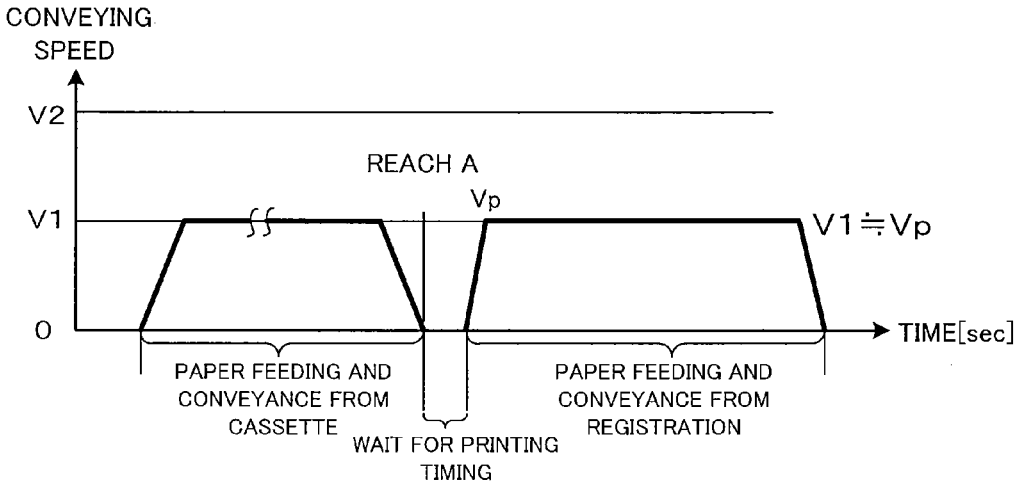
FIG. 10 is a speed chart in feeding and conveyance of the sheets of a size equal to or larger than A4-R, which can be registration-accelerated, stored in a third stage paper feeding cassette or a fourth stage paper feeding cassette.

FIG. 9 is a speed chart of, in continuous conveyance of sheets of a sheet size equal to or smaller than the A4-R size stored in the CST3 or the CST4, conveying speed from the paper feeding cassette to the registration position A and conveying speed from the registration position A. FIG. 10 is a speed chart of, in continuous conveyance of sheets of the A3 size stored in the CST3 or the CST4, conveying speed from the paper feeding cassette to the registration position A and conveying speed from the registration position A. In the speed charts shown in FIGS. 9 and 10, since it is difficult to instantaneously perform speed change in the DC brushless motor, paper feeding and conveying speeds of the first sheet and the second and subsequent sheets are the same.

In FIG. 9, the sheet of the A4-R size in, for example, the third stage paper feeding cassette at a long distance from the registration position A is conveyed to the registration position A at the high-speed conveying speed (V2) to secure a temporal margin until registration restart. The sheet put on standby in the registration position A is conveyed at the printing timing at the same high-speed conveying speed (V2) until the leading end of the sheet reaches the acceleration end position B. Thereafter, the sheet is conveyed at the process speed (Vp).

FIG. 10 is a speed chart of, in conveyance of, for example, the A3 size sheet stored in the CST3 or the CST4, conveying speed from the paper feeding cassette to the registration position A and conveying speed from the registration position A.

Since a distance from the registration position A to the third stage paper feeding unit 20 is shorter than the conveying length of the A3 size sheet, the sheet is conveyed to the registration position A at the low-speed conveying speed (V1) and conveyed from the registration position A at the printing timing at the process speed (Vp).

The conveying speed charts shown in FIGS. 5 to 10 are the same when the sheet is plain paper and when the sheet is thick paper.

The present invention can be carried out in other various forms without departing from the spirit or main characteristics thereof. Therefore, the embodiment is merely an illustration in every aspect and should not be limitedly interpreted. The scope of the present invention is indicated by claims and is not restricted by the text of this specification at all. Further, all modifications, various improvements, substitutions, and alternations belonging to a scope of equivalents of the claims are within the scope of the present invention.

As explained above in detail, according to the present invention, it is possible to provide an image forming apparatus.

What is claimed is:

1. An image forming apparatus comprising:

a sheet conveying path that conveys sheets, which are fed from paper feeding cassettes in plural stages by paper feeding rollers, to registration rollers with conveying rollers corresponding to the respective paper feeding cassettes and conveys the sheets to a printing position with the registration rollers;

a variable-speed registration motor that drives the registration rollers;

conveyance motors that drive the respective conveying rollers, at least some of which, including those that drive conveying rollers of an upper stage side paper feeding cassette, are variable-speed conveyance motors;

paper feeding motors that drive the paper feeding rollers; and a control unit that performs driving control for the registration motor, the conveyance motors, and the paper feeding motors, and varies conveying speed of the sheets conveyed to the registration rollers according to a sheet size of a sheet to be fed and a stage position of the paper feeding cassette selected from the paper feeding cassettes.

2. The apparatus according to claim 1, wherein the control unit has an inter-sheet changing mode for setting sheet conveying speed by the registration rollers to plural conveying speeds which differ from each other in a period until a leading end of the sheet reaches the printing position, and the control unit drives, in the inter-sheet changing mode, the conveying rollers concurrently with sheet conveying speed by the registration rollers.

3. An image forming apparatus comprising:

a sheet conveying path that conveys sheets, which are fed from paper feeding cassettes in plural stages by paper feeding rollers, to registration rollers with conveying rollers corresponding to the respective paper feeding cassettes and conveys the sheets to a printing position with the registration rollers;

a variable-speed conveyance motor that drives the conveying rollers corresponding to an upper stage side paper feeding cassette;

a clutch that engageably and disengageably transmits a driving force of a paper feeding motor to the paper feeding rollers corresponding to a lower stage side paper feeding cassette;

a clutch that engageably and disengageably transmits a driving force of the conveyance motor to the conveying rollers corresponding to the lower stage side paper feeding cassette; and a control unit that performs driving control for a registration motor, the clutches, the conveyance motor, and the paper feeding motor, and varies conveying speed of the sheets conveyed to the registration rollers according to a sheet size of a sheet to be fed and a stage position of the paper feeding cassette selected from the paper feeding cassettes and sets the conveying speed of the conveying rollers to be common and a plurality of various conveying speeds in conveying the sheet from the conveying rollers corresponding to the lower stage side paper feeding cassette to the conveying rollers corresponding to the upper stage side paper feeding cassette.

4. The apparatus according to claim 3, wherein the variable-speed motor is a pulse motor.

5. The apparatus according to claim 3, wherein a fixing device is arranged above the printing position.

6. The apparatus according to claim 3, wherein the control unit has an inter-sheet changing mode for setting sheet conveying speed by the registration rollers to plural conveying speeds which differ from each other in a period until a leading end of the sheet reaches the printing position, and the control unit drives, in the inter-sheet changing mode, the conveying rollers concurrently with sheet conveying speed by the registration rollers.

7. The apparatus according to claim 6, wherein the control unit sets, in the inter-sheet changing mode, the sheet conveying speed by the registration rollers to registration acceleration conveying speed higher than image printing speed from the start of sheet conveyance until the sheet reaches the printing position and sets the sheet conveying speed to the image printing speed after the sheet reaches the printing position.

8. The apparatus according to claim 6, wherein a transfer roller that transfers a toner image formed on an intermediate transfer belt, which moves at circumferential speed equal to process speed, onto the sheet that is arranged in the printing position, and the control unit sets, in the inter-sheet changing mode, the sheet conveying speed by the registration rollers to registration acceleration conveying speed higher than the process speed from the start of sheet conveyance until the sheet reaches the transfer roller and sets the sheet conveying speed to the process speed after the sheet reaches the transfer roller.

9. The apparatus according to claim 6, wherein the control unit determines, according to whether printing is color printing, whether the control unit shifts to the inter-sheet changing mode.

10. The apparatus according to claim 6, wherein the control unit determines, according to whether a sheet conveying length is equal to or smaller than a specific length, whether the control unit shifts to the inter-sheet changing mode.

11. The apparatus according to claim 6, wherein the control unit determines, according to whether printing is color printing and whether a sheet conveying length is equal to or smaller than a specific length, whether the control unit shifts to the inter-sheet changing mode.

12. The apparatus according to claim 6, wherein a sheet conveying length for determining whether the control unit shifts to the inter-sheet changing mode is different according to a stage number position of a paper feeding cassette.

13. The apparatus according to claim 6, wherein the control unit determines, according to whether printing is color printing, a stage number position of a selected paper feeding cassette, and whether a sheet conveying length of sheets stored in the paper feeding cassette is equal to or smaller than a specific length, whether the control unit shifts to the inter-sheet changing mode.

14. The apparatus according to claim 6, wherein the control unit determines, according to a stage number of a paper feeding cassette, whether the control unit shifts to the inter-sheet changing mode.

15. The apparatus according to claim 6, wherein the control unit moves a conveyed sheet through the sheet conveying path at printing speed in the printing position without shifting to the inter-sheet changing mode when a conveying length of the sheet is equal to or larger than a specific length.

16. The apparatus according to claim 6, wherein, when the control unit shifts to the inter-sheet changing mode, the control unit sets the sheet conveying speed for conveying the sheets to the registration rollers different in a first sheet and a second sheet and subsequent sheets.

17. The apparatus according to claim 6, wherein, when the control unit shifts to the inter-sheet changing mode, the control unit applies conveying speed in the inter-sheet changing mode to the sheets from a first sheet.

18. The apparatus according to claim 6, wherein, when the control unit does not shift to the inter-sheet changing mode, the control unit sets conveying speed for conveying a second sheet to the registration rollers higher than conveying speed for conveying a first sheet to the registration rollers.

* * * * *